United States Patent [19]

Newman

[11] Patent Number: 5,054,252

[45] Date of Patent: Oct. 8, 1991

[54] SYSTEM FOR SEALING ASBESTOS CONTAMINATED MATERIAL IN BUILDING CRAWL SPACE

[75] Inventor: Eugene E. Newman, Maple Shade, N.J.

[73] Assignee: GPAC, Inc., Pennsauken, N.J.

[21] Appl. No.: 505,486

[22] Filed: Apr. 6, 1990

[51] Int. Cl.[5] ..... E04B 1/92; E02D 19/00

[52] U.S. Cl. ..... 52/169.14; 52/742; 52/746; 52/302

[58] Field of Search ..... 52/169.11, 169.14, 742, 52/746, 408, 302; 428/443; 98/33.1, 115.1

[56] References Cited

U.S. PATENT DOCUMENTS

| | | | |
|---|---|---|---|
| 2,899,771 | 8/1959 | Burris | 52/169.14 |
| 3,688,457 | 9/1972 | Sherno | 52/169.11 |
| 4,401,636 | 8/1983 | Flowers | 428/443 |
| 4,604,111 | 8/1986 | Natale | 98/33.1 |
| 4,626,291 | 12/1986 | Natale | 98/115.1 |
| 4,907,386 | 3/1990 | Ekroth | 52/169.14 |
| 4,908,068 | 3/1990 | Pittman et al. | 428/443 |

*Primary Examiner*—James L. Ridgill, Jr.

*Attorney, Agent, or Firm*—Fleit, Jacobson, Cohn, Price, Holman & Stern

[57] ABSTRACT

An impermeable membrane seals a layer of asbestos contaminated material and contaminated earth of an earthen floor so as to prevent airborne contamination by asbestos fibers to a crawl space located underneath a building. The asbestos contaminated material is permanently encapsulated in the crawl space with the impermeable membrane which allows walking or crawling through the crawl space without the asbestos contaminated material becoming airborne due to the stretchability of the impermeable membrane. In addition, any gas entrapped by the impermeable membrane is vented to the outside by a hollow tube passing through the membrane and communicating with the outside of the building. Optionally, cementatious material may be entrapped between the earthen floor and the impermeable membrane which, upon mixture with condensate formed on the undersurface of the membrane, would harden and rigidify the asbestos contaminated material in place.

11 Claims, 2 Drawing Sheets

SYSTEM FOR SEALING ASBESTOS CONTAMINATED MATERIAL IN BUILDING CRAWL SPACE

FIELD OF THE INVENTION

This invention relates to the sealing of asbestos contaminated material located in a basement crawl space having an earthen floor.

BACKGROUND OF THE INVENTION

Typically in low lying buildings such as in schools, a crawl space is located beneath the first floor which includes classrooms and offices. Oftentimes, the height of the crawl space is less than would be required for a person to walk erect and therefore, the use of the crawl space is limited. Typically, lengths of utility lines such as pipes and wiring extend through the crawl space to communicate between different areas of the overhead building.

The ceiling of the crawl space forms the floor for the first floor of the building and the floor of the crawl space is formed by unexcavated earth into which concrete supports, walls or foundation walls formed of masonry blocks, have been erected to define the side walls of the crawl space. The concrete supports, walls or foundation walls formed of masonry blocks, support the building overhead, typically of one to three floors in height. Additional support may be provided by columns of concrete, masonry block or steel placed throughout the crawl space or at the perimeter support walls.

As has recently been publicized, many public facilities, such as schools, have been found to include asbestos containing materials such as insulation surrounding pipes, duct work and conduits and insulation or fireproofing for the building. It is essential that the asbestos contamination be removed from these facilities with minimum exposure to airborne asbestos particles so as to minimize the health hazard to the asbestos removal workers as well as those who will be using the building after the asbestos has been removed.

A problem encountered in the crawl space of low lying buildings which include different forms of asbestos insulation or fireproofing is that over time, the asbestos insulation or fireproofing, such as for example pipe lagging which includes asbestos particles, deteriorates and falls by gravity to the exposed earth below. Anyone attempting to make repairs to any of the utilities located in the crawl space are not only exposed to the asbestos contamination from the deteriorating insulation or fireproofing but by treading on the earthen floor, the asbestos contamination which has already fallen to the ground is disturbed and becomes airborne, which is its most dangerous condition.

A proposed solution to this problem has been to excavate a substantial amount of earth from the crawl space to a predetermined depth to ensure removal of the asbestos particles which have fallen to and mixed with the earthen floor. Due to the limited area of movement in a crawl space and the amount of earth which would be required to be removed, this solution would prove quite costly and time consuming. An alternate solution has been to pour a thin layer of concrete over the earthen floor. Due to the limited area of movement in a crawl space this solution also has proven to be time consuming and costly.

SUMMARY OF THE INVENTION

This invention relates to the serious dangers associated with persons exposed to asbestos contaminated materials. This invention is particularly useful for protecting an enclosed environment such as occurs when asbestos coatings are being removed inside a building structure, and particularly a crawl space located under the ground floor of a building.

By the present invention, a system has been devised for permanently sealing asbestos contaminated material covering the earthen floor of a crawl space with an impermeable membrane having a high degree of flexibility so that if someone were to walk on the membrane, the membrane would yield to the forces exerted against it and prevent disturbing the asbestos contamination which has mixed with the earthen floor. As a further benefit, it is possible to entrap any gases migrating from the ground into the crawl space and to exhaust the gases out of the area of the crawl space located below the membrane.

It is envisioned that prior to sealing the asbestos contamination with the earthen floor, a cementatious material, such as premixed concrete powder, could be applied to the earthen floor so that upon condensation of moisture evaporating from the earth and collecting on the underside of the membrane, would cause the cementatious material to solidify and rigidly encapsulate the asbestos contaminated material.

It is therefore an object of the present invention to provide a system for encapsulating asbestos contaminated material and the earthen floor of a crawl space.

It is another object of the present invention to provide a system for encapsulating asbestos contaminated material and the earthen floor of a crawl space with an impermeable, stretchable membrane located above the asbestos contaminated material and the earthen floor for sealing the asbestos contaminated material and the earthen floor.

It is yet another object of the present invention to provide a system for encapsulating asbestos contaminated material and the earthen floor of a crawl space with an impermeable, stretchable membrane located above the asbestos contaminated material and the earth for sealing the asbestos contaminated material and the earthen floor where prior to application of the membrane, a cementatious material is mixed with the asbestos contaminated material located on the earthen floor.

It is still yet another object of the present invention to provide a system for encapsulating asbestos contaminated material and the earthen floor of a crawl space with an impermeable, stretchable membrane located above the asbestos contaminated material and the earthen floor for sealing the asbestos contaminated material and the earthen floor where prior to application of the membrane, a cementatious material is mixed with the asbestos contaminated material located on the earthen floor and an exhaust pipe is connected to the space located below the membrane so as to exhaust any gases collected below the membrane.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
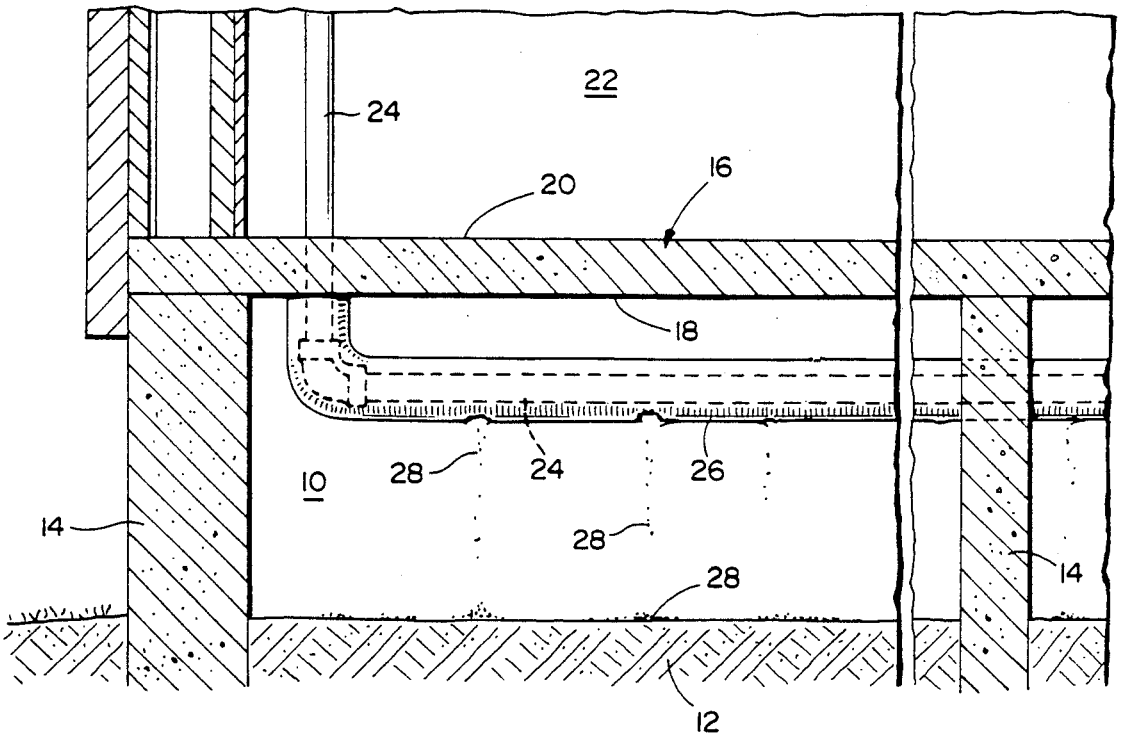
FIG. 1 is a sectional elevational view of a crawl space located below a building.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
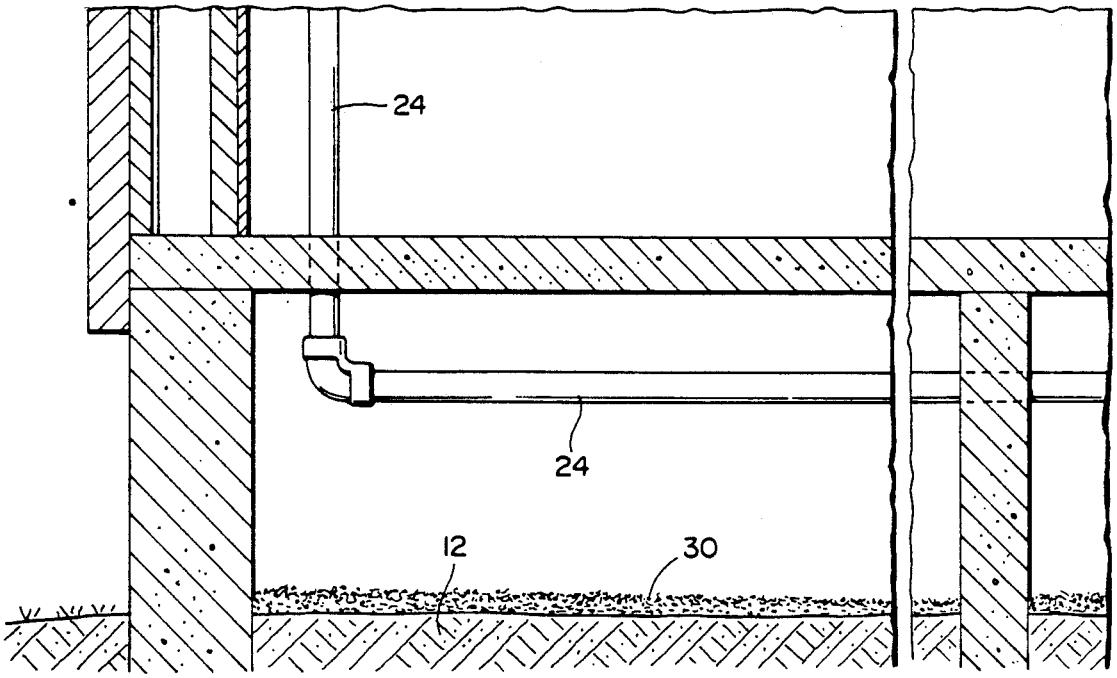
FIG. 2 illustrates the asbestos insulation surrounding a pipe as shown in FIG. 1, removed from the pipe.
Figure 3:
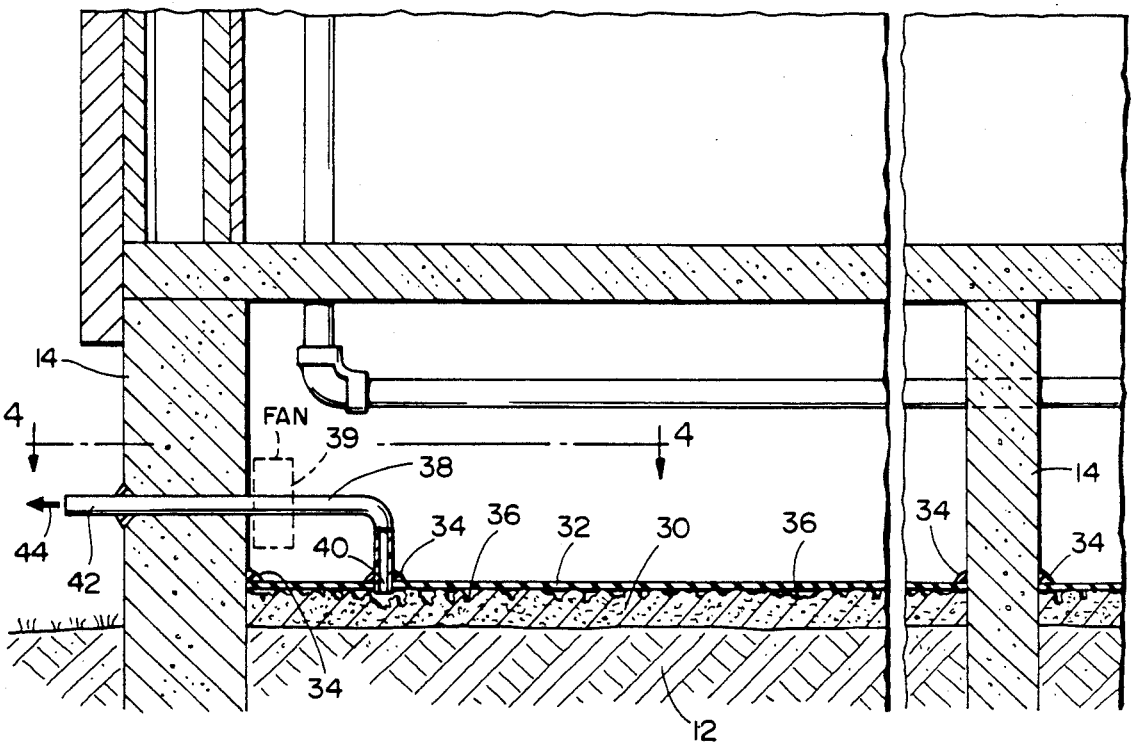
FIG. 3 illustrates an impermeable membrane sealing the asbestos insulation located on the earthen floor shown in FIG. 2.

With reference to the drawings, in general, and to FIGS. 1 through 3, in particular, a system for sealing asbestos in a building crawl space, embodying the teachings of the subject invention is shown with respect to a crawl space 10 with an earthen floor 12. Vertical concrete supports 14 extend from the earthen floor 12 to support a slab 16 which forms the ceiling 18 of the crawl space and the floor 20 of the first floor 22 cf the building formed above the crawl space.

Extending from the floor 22 and through the slab 16 is a pipe 24. The pipe 24 is representative of utility lines that pass between the first floor 22 of the building and the crawl space 10. In the example shown in FIG. 1, the pipe 24 is surrounded in the crawl space by asbestos-containing insulation lagging 26. The asbestos containing pipe lagging is used to insulate the pipe 24 and, for the purposes of this invention, was applied to the pipe at a time prior to knowing the full hazards associated with the use of asbestos.

Over time, the pipe lagging begins to deteriorate as shown in FIG. 1, and pieces 28 of the lagging begin to fall, by gravity, from the pipe lagging and settle on the earthen floor 12 of the crawl space. The deterioration of the lagging may be caused by several factors such as exposure to the elements or continuous exposure to high temperatures in the case of hot water flowing through the pipe 24. If a workman were to enter the crawl space 10 to attempt to repair any of the utility lines passing through the crawl space, the pieces 28 of lagging located on the earthen floor 12 would be disturbed and become airborne. This would produce a great health hazard for the workman.

It is now recognized that the asbestos materials contained in pipe lagging insulation when in a deteriorating condition pose a substantial health hazard. Attempts are now made to isolate the asbestos containing material so as to prevent the threat of a health hazard.

In FIG. 2, all of the pipe lagging 26 from the pipe 24 is removed in accordance with EPA/OSHA guidelines using a "negative-air" particulate contamination control method as embodied in U.S. Pat. No. 4,604,111 and/or with glove bags of U.S. Pat. No. 4,626,291. Some of the pieces 28 being removed may fall to the earthen floor 12 and mix with the soil. This procedure will be done under accepted asbestos removal conditions where the workmen are fully protected from contact with or inhalation of the airborne asbestos particles. It is the intent of this invention to isolate, encapsulate, and enclose any asbestos contaminants that mix with the crawl space soil prior to or during the removal process.

In FIG. 2, the pieces 28 of pipe lagging 26 mixed with the soil prior to or during the removal process form a layer 30 of asbestos contaminated particles. Once all the asbestos contaminated particles have been removed from the utility lines in the crawl space by the removal process, an impermeable membrane 32 is positioned on top of the layer 30, as shown in FIG. 3, so as to completely cover the layer 30 to prevent any airborne release of asbestos contaminated pieces 28 from the layer 30.

The impermeable membrane 32 may be an APPI Modified Bitumen Roofing Membrane available from Firestone Roofing Systems of Lancaster, Pa., having a thickness of 160 mils +/−5 mils with a minimum performance of ultimate elongation of 57%. Another example of an acceptable membrane would be EPDM Rubbergard ® available from Firestone Roofing Systems in 45 ml or 60 ml thickness with a minimum elongation of 300%. Other membranes may be used as long as they include the desired qualities of impermeability to prevent the migration of asbestos fibers through the membrane and stretchability to allow workmen to walk on the membrane without tearing the membrane as compensated for by the stretching of the membrane.

In FIG. 3, the membrane 32 is shown extending between concrete pillar supports 14. Along the edge of each side wall is a fillet 34 which completely seals the joint between the membrane and the supports 14. A sealing fillet will be used at every point of contact between a membrane and an object which must be abutted or surrounded. The fillet as well as any seams between sections of the impermeable membrane may be formed by Firestone Roofing Systems splice adhesive SA-1065, bonding adhesive BA-2004S, lap sealant LS-3029, fastener sealer, waterblock seal and/or pourable seal S-10.

Figure 4:
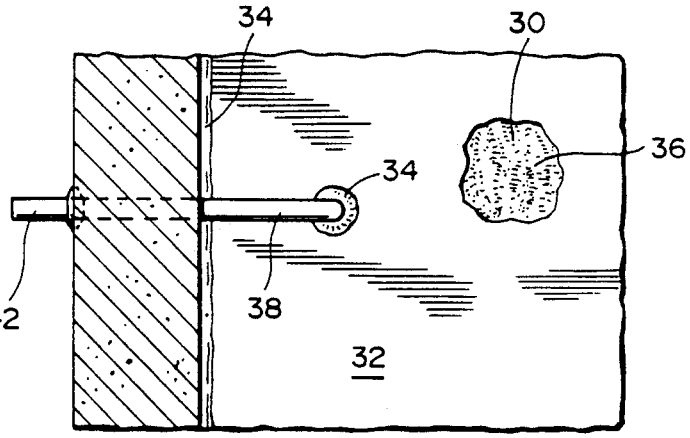
FIG. 4 is a sectional view taken along line 4—4 of FIG. 3.

By the membrane 32 and fillets 34 located at seams and legs, a moisture and air impermeable membrane is secured above the layer 30 of asbestos contaminated particles. It is also envisioned to include, in an alternate system, prior to placement of the membrane 32, a cementatious material 36 on top of the layer 30 of asbestos contaminated particles. After the membrane 32 is sealed over the layer 30 and material 36, moisture from the ground migrating towards the membrane 32 as trapped below the membrane, would mix with the cementatious material 36 so as to rigidify the cementatious material 36 and further encapsulate the layer 30 in a rigid form. In FIG. 4, a sectional, partially cut away view of the membrane illustrates the combined layer 30 of asbestos contaminated particles and cementatious material 36 located below the membrane 32.

In addition, due to the sealing of the earthen floor 12 by the membrane 32, gases migrating from the earth, such as radon, for example, would also be contained below the membrane. To remove the collected gases, a pipe 38 having one end 40 extending through the membrane 32 and an opposite end 42 passing through the vertical support 14 would allow for gas to migrate from below the membrane 32 to the end 42 of pipe 38 and be exhausted to the exterior of the building in the direction of arrow 44. The pipe may be extended to other locations below the membrane with appropriately sized openings to form a ducted collection system. An inline fan 39 may also be installed in the pipe to improve the collection of gases and vapors. A further option would be to mount an exhaust fan on an exterior wall at the termination of the ductwork. These fans could be manual switch controlled; manual or automatic timer controlled; or automatically controlled through a gas or vapor sensing device.

By the present invention, an impermeable membrane seals a layer of asbestos contaminated material and contaminated earth of an earthen floor so as to prevent airborne contamination by asbestos fibers to a crawl space located underneath a building. The asbestos contaminated material is permanently encapsulated in the crawl space with the impermeable membrane which allows walking or crawling through the crawl space without the asbestos contaminated material becoming airborne due to the stretchability of the impermeable membrane. In addition, any gas entrapped by the impermeable membrane is vented to the outside by a hollow tube passing through the membrane and communicating with the outside of the building. Optionally, cementatious material may be entrapped between the earthen floor and the impermeable membrane which, upon mixture with condensate formed on the undersurface of the membrane, would harden and rigidify the asbestos contaminated material in place.

Having described the invention, many modifications thereto will become apparent to those skilled in the art to which it pertains without deviation from the spirit of the invention as defined by the scope of the appended claims.

I claim:

1. An arrangement for entrapping asbestos contaminated particles within a portion of a building, which comprises:

a crawl space in the building having side walls, a ceiling, and an earthen floor with said ceiling being spaced from said earthen floor, a layer of asbestos contaminated particles located on top of said earthen floor and within said crawl space, and sealing means located on top of said layer of asbestos contaminated particles for sealing said layer of asbestos contaminated particles between said sealing means and said earthen floor, said sealing means including an impermeable membrane sealed to said side walls.

2. An arrangement for encapsulating asbestos contaminated particles as claimed in claim 1, wherein a layer of cementatious material is located with said layer of asbestos contaminated particles between said sealing means and said earthen floor.

3. An arrangement for encapsulating asbestos contaminated particles as claimed in claim 1, wherein a tube communicates with an area below said sealing means and the outside of said building for passage of gas trapped below said sealing means.

4. An arrangement for encapsulating asbestos contaminated particles as claimed in claim 1, wherein said impermeable membrane is stretchable so that workmen may walk on said impermeable layer without tearing of said impermeable layer.

5. A method of encapsulating asbestos contaminated particles, said method comprising:

providing an enclosed space of a building defined by side walls, a ceiling and an earthen floor, said ceiling being spaced from said earthen floor, said enclosed space including utility lines having asbestos contaminated particles, removing said asbestos contaminated particles from said utility lines with some of said asbestos contaminated particles settling in a layer on said earthen floor, and sealing said layer and said earthen floor with an impermeable membrane extending between and sealed to said side walls so as to prevent migration of said asbestos contaminated particles mixed with the earthen floor away from said earthen floor.

6. A method of encapsulating asbestos contaminated particles as claimed in claim 5, wherein a layer of cementatious material is added to said layer of asbestos contaminated particles prior to sealing of said layer of asbestos contaminated particles and said earthen floor.

7. A method of encapsulating asbestos contaminated particles as claimed in claim 5, further comprising communicating an area which has been sealed with the exterior of said building to vent gas entrapped by said sealing step.

8. A method of sealing asbestos contaminated particles located in a crawl space of a building having an earthen floor, said method comprising:

disrupting the asbestos contaminated particles in the crawl space, allowing the asbestos contaminated particles to settle on said earthen floor, and covering said asbestos contaminated particles and said earthen floor with an impermeable membrane sealed to side walls of said crawl space at its periphery to prevent migration of said asbestos contaminated particles through or around said membrane so as to seal said asbestos contaminated particles and said earthen floor from said crawl space and thereby forming a new floor of said crawl space.

9. A method of sealing asbestos contaminated particles as claimed in claim 8, wherein said membrane is stretchable.

10. An arrangement for entrapping asbestos contaminated particles within a portion of a building which comprises:

a crawl space in the building having side walls, and a ceiling, and an earthen floor with said ceiling being spaced from said earthen floor, a layer of asbestos contaminated particles located on top of said earthen and within said crawl space, and sealing means located on top of said layer of asbestos contaminated particles for sealing said layer of asbestos contaminated particles between said sealing means and said earthen floor, said sealing means including a stretchable, impermeable membrane of substantially uniform thickness sealed to said side walls by a sealing material.

11. A method of encapsulating asbestos contaminated particles, said method comprising:

providing an enclosed space of a building defined by side walls, a ceiling and an earthen floor, said ceiling being spaced from said earthen floor, said enclosed space including utility lines covered by asbestos contaminated particles, removing said asbestos contaminated particles from said utility lines with some of said asbestos contaminated particles settling in a layer on said earthen floor, and covering said layer and said earthen floor with at least one section of an impermeable membrane of substantially uniform thickness extending between and sealed to said side walls so as to prevent migration of said asbestos contaminated particles mixed with the earthen floor away from said earthen floor.

* * * * *